US008590437B2

(12) United States Patent
Gettle

(10) Patent No.: US 8,590,437 B2
(45) Date of Patent: Nov. 26, 2013

(54) BLAST EFFECT MITIGATING ASSEMBLY USING AEROGELS

(76) Inventor: Guy Leath Gettle, Alamo, CA (US)

( * ) Notice: Subject to any disclaimer, the term of this patent is extended or adjusted under 35 U.S.C. 154(b) by 164 days.

(21) Appl. No.: 12/735,666

(22) PCT Filed: Feb. 4, 2009

(86) PCT No.: PCT/US2009/000730

§ 371 (c)(1),
(2), (4) Date: Aug. 4, 2010

(87) PCT Pub. No.: WO2009/099621

PCT Pub. Date: Aug. 13, 2009

(65) Prior Publication Data

US 2010/0307327 A1 Dec. 9, 2010

Related U.S. Application Data

(60) Provisional application No. 61/063,852, filed on Feb. 5, 2008.

(51) Int. Cl.
*F41H 5/06* (2006.01)

(52) U.S. Cl.
USPC ..... 89/36.02; 89/918

(58) Field of Classification Search
USPC ..... 89/36.01, 36.02, 36.08, 36.04, 36.11, 89/36.12; 86/50; 102/303
See application file for complete search history.

(56) References Cited

U.S. PATENT DOCUMENTS 2,350,513 A * 6/1944 Leadbetter ..... 52/145
2,872,710 A * 2/1959 Cox ..... 52/407.3
3,949,827 A * 4/1976 Witherspoon ..... 181/284
4,352,851 A * 10/1982 Heitz et al. ..... 442/222
4,706,422 A * 11/1987 Ashton ..... 52/145
4,822,657 A * 4/1989 Simpson ..... 428/69
4,903,573 A * 2/1990 Browne et al. ..... 86/50
4,989,688 A * 2/1991 Nelson ..... 181/287
5,217,185 A * 6/1993 Rucker ..... 244/121

(Continued)

FOREIGN PATENT DOCUMENTS

EP 0 706 596 B1 5/2002
WO WO 2007/005043 A2 1/2007

OTHER PUBLICATIONS

International Search Report and International Written Opinion for International Application No. PCT/US2009/000730, Mar. 25, 2009.

*Primary Examiner* — Bret Hayes
*Assistant Examiner* — Reginald Tillman, Jr.
(74) *Attorney, Agent, or Firm* — Jeffrey R. Ramberg

(57) ABSTRACT

An assembly for protecting against explosions and explosive devices is formed with aerogels and frangible components. The basic configuration forms a space between an object to be protected by an aerogel having a frangible backing layer. Such assemblies may be mounted on vehicles and structures, and alternatively used as barriers without attachment to other objects. Different geometries for the rear surface of the assemblies enhance the ability of deflecting gas produced by explosions away from objects to be protected. Flowable attenuating media may be introduced into the space behind the aerogel and in gratings placed in the front of assemblies in order to increase blast energy dissipation in intense blast conditions. Armor components may be added to the rear surface to protect against fragments and projectiles. Aerogels, metal foams, and dense ceramic beads may be incorporated to enhance protection against explosively-formed penetrators and other projectiles.

38 Claims, 5 Drawing Sheets

(56) References Cited

U.S. PATENT DOCUMENTS

| | | | | |
|---|---|---|---|---|
| 5,225,622 | A * | 7/1993 | Gettle et al. | 86/50 |
| 5,394,786 | A * | 3/1995 | Gettle et al. | 86/50 |
| 5,444,955 | A * | 8/1995 | Ou | 52/309.9 |
| 5,654,518 | A * | 8/1997 | Dobbs | 89/36.02 |
| 5,746,537 | A * | 5/1998 | Kellas et al. | 404/6 |
| 6,035,602 | A * | 3/2000 | Lafond | 52/786.13 |
| 6,298,765 | B1 * | 10/2001 | Dvorak | 89/36.02 |
| 6,302,026 | B1 * | 10/2001 | Parkes | 102/303 |
| 6,592,981 | B1 * | 7/2003 | Rawal et al. | 428/312.8 |
| 6,598,358 | B1 * | 7/2003 | Schwertfeger et al. | 52/145 |
| 7,078,359 | B2 * | 7/2006 | Stepanian et al. | 442/59 |
| 7,322,267 | B1 | 1/2008 | Munson, Jr. | |
| 7,437,987 | B1 * | 10/2008 | Ohnstad et al. | 89/36.04 |
| 7,575,797 | B2 * | 8/2009 | Karr et al. | 428/137 |
| 7,641,954 | B2 * | 1/2010 | Rouanet et al. | 428/76 |
| 7,698,985 | B2 * | 4/2010 | Tapp et al. | 89/36.02 |
| 7,866,106 | B2 * | 1/2011 | Bowlware | 52/424 |
| 2002/0053279 | A1 | 5/2002 | Jung et al. | |
| 2005/0085146 | A1 * | 4/2005 | Farkas et al. | 442/134 |
| 2005/0252946 | A1 | 11/2005 | Westermann et al. | |
| 2006/0179760 | A1 * | 8/2006 | Burg | 52/479 |
| 2006/0272727 | A1 * | 12/2006 | Dinon et al. | 138/149 |
| 2007/0006723 | A1 * | 1/2007 | Waddell et al. | 89/36.02 |
| 2007/0245887 | A1 * | 10/2007 | James | 89/36.01 |
| 2008/0264245 | A1 * | 10/2008 | Barnes et al. | 89/36.02 |
| 2009/0272254 | A1 * | 11/2009 | Hunn et al. | 89/36.02 |
| 2011/0072960 | A1 * | 3/2011 | Hallissy et al. | 89/36.02 |
| 2011/0174144 | A1 * | 7/2011 | Kuchinsky et al. | 89/36.02 |

* cited by examiner

BLAST EFFECT MITIGATING ASSEMBLY USING AEROGELS

CROSS-REFERENCE TO RELATED APPLICATIONS

This patent document is a PCT National Phase filing under 35 U.S.C. §371 from International Patent Application Serial No. PCT/US09/00730 , filed on Feb. 4 2009 which claimed the benefit of U.S. Provisional Patent Application Ser. No. 61/063,852, filed on Feb. 5, 2008 , each in the name of Guy Leath Gettle. The entire contents of each of these commonly owned patent applications is expressly incorporated herein by reference

TECHNICAL FIELD

This invention relates to assemblies that can be used to reduce damage from explosions, and specifically to walls, barriers, and armor used to protect vulnerable spaces and areas from hazards created by blasts.

BACKGROUND ART

People, vehicles, chemical process facilities and many manufacturing operations are vulnerable to hazards produced by explosions. The source of explosions may be a munition intended to inflict damage and injury or may be fuel or dust released in an accident. Regardless of the cause, explosions arising from rapid combustion processes generate shock waves, intense heat, and gas whose pressure significantly exceeds the ambient condition.

Many materials, structures, methods and other inventions have been developed that offer some protection against undesirable effects created by explosions. Most of these inventions are in the form of armor or barriers that isolate the blast from people or spaces requiring protection. Armor and barriers are typically used to protect vehicle and building interiors exposed to external explosions.

For explosions occurring outdoors, another protective measure is using components to deflect blasts away from objects. This technique does not work for confined environments. Blast protection for internal explosions typically involves venting. The existing art does not generally provide protection of people for intense blasts in confined environments, with or without venting.

Design of blast protection structures generally must consider characteristics of the explosive threat. Choice of materials, type of protective measure, and structural components also depends upon whether or not a need exists for the protective element to remain intact following an explosion. Even when all of the essential considerations are made, weight, space and geometrical constraints often render current technologies inadequate. This is particularly the case for intense blast environments.

Examples of the latter include internal spaces within aircraft, containers with explosives inside, tunnels, and corridors of buildings. The inadequacy of the current art becomes more apparent as explosive charge weight of the threat increases. The number of vehicles and buildings destroyed with large explosive charges over the last decade have vividly demonstrated the shortcomings of the present art.

Another inadequacy of the present art is inability to defend against a type of munition referred to as a shaped charge. Heavy, bulky armor assemblies using the current art are required to prevent penetration of metal jets produced by shaped charge devices. There are many versions of shaped charge devices, including ones generally termed "explosion-formed penetrators" or "EFPs".

All versions of shaped charge munitions utilize an explosive with a thin metal lining on the charge surface facing the intended target. Detonation of the charge converts the metal lining into a projectile capable of penetrating deeply into any material or armor.

When the penetrator pierces armor, intense shock waves and hot blast gas follow through the hole formed by the metal slug. This is because most shaped charge devices detonate in close proximity to the target. These blast hazards generally inflict serious injury to people in an enclosed space such as a vehicle interior behind the pierced armor, including traumatic brain injury. The large number of casualties caused by EFPs and other shaped charge devices in recent conflicts illustrates yet another example of conventional approaches failing to provide adequate protection. Because of the widespread exposure of people and structures to many types of explosion hazards, there are many potential users who would welcome new materials and other inventions that could provide desired protection against specified blast threats with significantly less weight and with thickness no greater than required with armors of the present art. This includes practical means of reducing behind-armor blast effects caused by shaped charge munitions.

Developing improved methods of protecting against blasts and explosively formed projectiles requires consideration of all associated hazard phenomena. These hazards are described as follows.

Blast Wave Phenomenology Involving Solid Explosives

Hot gas produced by an explosion will expand rapidly. This expansion, along with rapid heating, will accelerate the molecules comprising air in the surrounding space. Localized acceleration of gas molecules creates pressure above ambient, often called "overpressure".

By definition, the compression process of explosions occurs faster than the acoustic speed of ambient air, thereby generating shock waves that propagate away from the blast. A blast event thus comprises an initial shock wave, followed by an accelerated gas pulse, then by formation of a hot gas cloud at elevated pressure (with debris if near the ground).

Explosion parameters such as pressure, impulse (momentum transfer), temperature, and shock wave pressure duration are strongly affected by interaction with objects interacting with a blast wave. Therefore, values of blast-associated physical parameters are not uniform across the space disturbed by the event.

Aerodynamic drag, and more particularly, shock reflections off liquid and solid surfaces, generate a significant range of the above parameters within any explosion that occurs near the earth's surface or structures. All of these values change quickly due to the transient nature of blast effects.

Ideal Gas Models for Calculating Blast Wave Properties

For the foregoing reasons, approximations are often made using "ideal gas assumptions" for calculating values characterizing explosion phenomenology. Because of the range of parameter values and uncertainty in measuring these values in large explosions, calculations using ideal gas assumptions are generally adequate.

Ideal gas formulae are based upon relationships between measured pressure, temperature, and volume of numerous gases tested in experiments dating back to the nineteenth century. The mathematical linkage between these parameters applies from ambient atmospheric conditions (air density of approximately 1.169 kilograms per cubic meter and temperature of 25 degrees Celsius) to roughly 1,000 times ambient.

Beyond 1,000 bars, deviations from calculations made using ideal gas formulae are still less than 80% from actual values up to 400 bars and 300 degrees Kelvin. The use of a compressibility factor chosen from experimentally-derived diagrams enables use of ideal gas formulae to closely estimate gas properties at high temperatures and pressures.

By definition, shock waves propagate at velocities above the acoustic speed in the medium. Velocity of shock waves and objects traveling in air are often reported in terms of the Mach number or Mach speed M, defined as the ratio of velocity to the speed of sound (acoustic speed) a in the local medium. Using ideal gas assumptions, the following relationships apply for an isentropic process:

$$P_0/P=[1+M^2(k-1)/2]^{k/(k-1)} \quad \text{and} \quad p_0/p=[1+M^2(k-1)/2]^{1/k-1)}$$

where $P_0$ and $p_0$ are the pressure and density, respectively, of the ambient gas, P and p are respectively the pressure and density in the medium at a point in the moving gas stream, M is the Mach speed of the moving gas stream, and k is the ratio of the specific heats respectively at constant volume and pressure of the subject gas. Shock wave propagation is so rapid that the isentropic assumption is valid in most applications involving explosions.

Acceleration of Gas Components

Shock waves accelerate atomic and molecular species comprising the gas medium to what is typically called the "particle velocity" or "blast wind". The initial value of velocity of the accelerated molecules is defined as the particle velocity, designated $u_p$. Using ideal gas assumptions, the relationship between particle velocity and the acoustic speed in the ambient air is $$u_p/a_x=5(M_x^2-1)/6M_x$$

where $a_x$ is the ambient-air acoustic speed and $M_x$ the Mach speed of the moving air mass with respect to the ambient air.

For an explosive charges equivalent to approximately 10 to 20 kilograms of TNT (2, 4, 6-trinitrotoluene), accelerated hot gas will impinge upon surfaces separated between 0.5 and 1 meter from the charge at Mach speeds roughly between 5 and 12. Isentropic compression will increase gas density to roughly 5.5 times the ambient value. With heating to 1,600 degrees Celsius in quasi-static conditions, gas density in this space may increase to as much as 40 kilograms per cubic meter.

Also important to predicting blast parameters is consideration of shock waves reflecting from objects. Reflected shock waves propagate in gas that is made denser, hotter, and at greater pressure than present in the incident shock wave. Thus reflected shocks have faster velocities and generate much more destructive power than the incident shock wave.

In air at normal incidence, the ratio of reflected shock overpressure $P_r$ to incident overpressure $P_x$ in a gas with specific heat ratio k of 1.4 (such as air) is $$P_r/P_x=(4M_x^2-1)(7M_x^2-1)/3(M_x^2+5)$$

where $M_x$ is the Mach speed of the impinging shock wave. Reflected pressure can thus be as much as 8 times higher than for the blast wave impinging on a rigid surface. Advancing the art of blast protection for structures and vehicles requires substantial reduction of reflected shock parameters.

Deflagrations Involving Flammable Dusts and Gases

For true explosives, propagation of the combustion reaction occurs due to pressure. Because shock wave peak pressure is sufficient to propagate combustion, actual detonation occurs in true explosives.

In contrast, combustion in flammable, non-condensed materials is propagated by heat transfer. As noted previously, such a combustion reaction is termed a deflagration. Unlike with solid explosive materials, scaled distance comparisons of different flammable gases and dusts cannot be made.

Mass of the reactants and products involved with non-condensed phase deflagrations is typically much lower than with detonating solid explosives. Thus the inertia of explosions arising from flammable mists and vapors is considerably lower than encountered with solid explosive detonations.

Overpressure developed by a deflagration is mathematically linked to the flame front velocity and temperature as it advances into the unburned flammable material. Explosions involving flammable dusts, mist, and vapors begin at relatively low velocities. Flame front velocity will increase rapidly as it evolves more hot, high-pressure combustion product gas.

Radiation from the flame front will preheat the unreacted material, which increases its flammability. The accelerating flame front will generate turbulence that facilitates combustion, as will obstacles encountered by the advancing flame front. Unless cooled, decelerated, or the flame front moves into unreacted material outside the flammability range (ratio of flammable material to oxygen), velocity of the flame front will produce a shock wave, e.g. a deflagration.

Blast Deflectors

Oblique reflected shock parameters are typically lower than for normal shock incidence. They also transfer momentum to the impinging blast wave so that a substantial portion of the accelerated gas is diverted outward from the loaded surface, thereby reducing QSP load. Protective barriers or armor configurations that avoid normal blast wave incidence are thus generally helpful for protecting objects behind them.

A combination of computer modeling and experiments led to development of a standard deflector geometry for the US Army that could better protect vehicles from detonating ground mines. This deflector incorporated a wedge that fit on the center of the vehicle underside, adjoining surfaces that were closer to parallel with the ground, and with another angle change for the outer ends of the deflector that sloped more sharply upward—but not as steeply as the sides of the central wedge. A standard kit for protecting US Army trucks was subsequently developed using this deflector geometry.

The standard kit used rigid steel plate to make these deflectors. Although an improvement over flat-floored vehicles with respect to reducing QSP, use of such hard material could not reduce reflected blast parameters. Rigid surfaces generate severe reflected shock in every case.

The above deflector kits are impervious to gas flow as well as rigid. Thus they fail to substantially dissipate energy through irreversible aerodynamic drag losses as is possible by using perforated plates or grilles. This principle is well known and, in fact, was exploited by the US Army for mitigating blast effect for above-ground storage of large munition stockpiles during the 1980's and 1990's. The term applied to this concept by the US Army is "vented suppressive shielding".

Perforated deflectors would seemingly offer a solution to the problem of excessive quasi-static pressure. They are a solution for moderate and weak blasts, but mass flow rate in severe blast environments is so great that flow through holes will choke. At Mach 10, for example, the exit of a hole would need to be greater than 500 times the entrance diameter to avoid choked gas flow. Strong reflected shock parameters would still be produced, therefore, when choked flow conditions develop. Ground mines typically generate very severe blast conditions. Perforated deflectors made of conventional materials and with the present art would therefore be ineffective against most anti-armor ground mines.

Blast Parameters Requiring Mitigation

The greatest challenge to reducing the potential for harm from explosions is determining how to mitigate blast overpressure and impulse (momentum transfer). For protection of structures and vehicles against strong blasts, reducing impulse transmitted to and reflected from the object is most important.

Mitigating impulse requires that overpressure is strongly attenuated over the entire phase of blast loading. This is because duration of the blast load is much more difficult to reduce. In other words, reducing peak overpressure may not significantly affect impulse.

Indeed, one of the major shortcomings of the existing art is that mitigating materials and designs typically increase positive pressure duration. This allows quasi-static pressure ("QSP", which is roughly constant pressure prior to venting or release of gas through failure of confining surfaces) conditions to develop in the presence of large exposed areas.

Shock waves traveling through gas compressed by a blast serve to further increase pressure. Reducing the time of loading by pressurized gas has heretofore been impossible to achieve when venting of the hot gas is inadequate.

In intense blast environments, the time scale of the high-pressure phase is typically longer than is needed for the object loaded by the blast wave to respond. This is particularly the case for vehicles attacked by ground mines and structures loaded by detonations of large explosive charges nearby. Wall accelerations and acceleration of whole vehicles in these events often inflict severe damage before blast effect dissipates into the surrounding environment.

Reducing pressure during blast loading requires mitigation of several blast-related phenomena. First, reflected shock must be attenuated. Reflected shock parameters dominate determination of total impulse imparted to the target since reflected pressure is almost always greater than incident. Duration of the reflected pressure phase is much longer than the incident phase when wide surface areas are presented to the blast. Second, one must also strive to deflect or divert hot gas around the target. This is to minimize quasi-static pressure (QSP). Third, one must prevent superposition of the shock wave reaching the target with the particle velocity wave, particularly that of the arrival of the hot gas just after formation of the reflected blast wave. Fourth, one can create irreversible energy losses through aerodynamic, viscous, and frictional losses.

Further reductions of blast impulse in outdoor environments or large spaces can be achieved if the protective assembly resists formation of a concave surface. A concave surface will trap hot gas at elevated reflected pressures, thereby adding to QSP.

Specific Problems with QSP

Numerous tests have proven that substantial attenuation of shock wave overpressure and impulse is achieved when media consisting of two phases in a granular or bead form are in close proximity to the source of the explosion. A significant range of two-phase attenuating media have demonstrated the effectiveness of this approach. Hollow ceramic beads, volcanic foam glass granules such as perlite and pumice, polystyrene foam beads, vermiculite, and similar media have all been successful in this regard.

Despite these successes, however, residual impulse from strong blasts has still been adequate to produce substantial accelerations and blast loads on structures presenting a large surface area to the explosion. Partially- and fully-confined explosions within containment substantially lined with two-phase blast-mitigating media have proven even more destructive except for charges smaller than threats typically posed by terrorists and military munitions. The problem in each of these environments is primarily that of quasi-static pressure associated with rapid generation of hot blast product gas that cannot be vented or diverted quickly enough.

Materials for Reducing Blast Damage

As noted above, almost all homogeneous materials used for mitigating blasts consist of two phases, typically solid and gas: Water barriers have also been evaluated many times, where rupture of the confinement releases water that is transformed into droplets by the transmitting blast wave.

Recently, metallic foams have been tested against blast loads based upon expectations that their collapse at relatively low pressure, their cellular structure, and variable acoustic speed would provide beneficial effects. So have zeolites for similar reasons, attempting to take advantage of their porosity and compressibility.

Despite vigorous efforts around the world, however, no homogeneous materials in the existing art have demonstrated the ability to adequately protect vehicles and ordinary buildings against severe blasts generated by detonations of large charges of solid explosives. For reasons more fully explained in the following section, existing materials have proven only able to mitigate some of the damaging mechanisms.

Generally these same mitigating materials can actually enhance damage through other physical mechanisms. This unfortunate phenomenon has been observed with water barriers, aluminum foam, honeycomb, polymeric foam, slit-foil spheroids, aqueous foam, and occasionally with panel assemblies filled with bead materials consisting of two phases such as perlite.

Shock Wave Propagation in Condensed Media

The foregoing discussion addressed blast phenomena in gases such as air. Pressurized hot gas produced by blasts may impinge on structures and vehicles. Fragments and projectiles accelerated by explosions may also strike structures and vehicles. These impacts must also be considered for blast protection design.

An empirical mathematical linkage between shock wave propagation in condensed media (solids, liquids, and gels) and the acoustic speed has been documented through decades of experiments, which is $$U=C_0+su$$

where U is the shock wave velocity, u is particle velocity, $C_0$ is an empirical constant called the bulk acoustic speed and is the intercept of the U (vertical) axis on the U/u plane of a line drawn through the data plots, and s is the slope of this line. $C_0$ and s are specific to the material through which the shock wave travels.

Values of s range from 0.9 for gases to 1.5 for most metals, and almost 2 for water. Values of $C_0$ in metals range from 2.05 kilometers per second (km/s) for lead to greater than 5 km/s for aluminum alloys, around 0.9 for gases and 1.65 for water. Actual longitudinal sound speed (acoustic speed) is usually somewhat greater than $C_o$, but is much less than double. Sound speed for aluminum, for example, is 6.4 km/s, compared with its $C_0$ of 5.0-5.4 km/s. Although $C_0$ is not the actual acoustic velocity (which is generally called the "longitudinal acoustic velocity") of the material, it is linked to this physical parameter, generally being within 25% for most solid materials of commercial or military interest.

Shock wave pressures within materials are mathematically linked to density as well through the widely-used Bernoulli relationship $$P_1=p_0C_0(u_1-u_0)+p_0s(u_1-u_0)^2$$

where $P_1$ is the pressure at and behind the shock wave front, $u_1$ is the particle velocity behind the shock front, and $u_o$ is the particle velocity of the material in which the shock wave is traveling before its arrival ($u_0$=0 for material at rest). For ranges of military interest, one can readily see that low density results in lower shock wave pressure. Particle velocities are limited by this relationship for ranges of military interest, since velocities of military projectiles, shaped-charge penetrators, and fragments from exploding munitions fall between 0.3 to roughly 8 kilometers/second (km/s). Values for s, $C_0$ and $p_0$ are even more constrained.

Density and shock wave transmission velocity are linked in yet another way, specifically through a parameter termed "impedance". Impedance Z is defined as the mathematical product of density p and shock wave velocity U, or $$Z=pU$$

Although density varies somewhat, impedance Z is essentially constant over ranges of values applicable to most problems of practical concern. Impedance is very important to mechanisms involved with projectile and high-velocity fragment impact damage.

Shock Wave Propagation From One Material Into Another In Direct Contact

When shock waves travel through a material and reach a free surface (boundary with a lower-impedance medium), a rarefaction or relief wave will reflect back into the material. This rarefaction wave will have the same pressure as that of the low-impedance medium. When a shock wave transits any kind of material and reaches the interface with a solid material, what happens next is determined by the relative impedance of the 2 materials.

When a shock travels from a material having a higher impedance (Z) into a material of lower impedance, the shock wave will be reflected into the impinging medium and transmit into the impacted material as well. Pressure at the interface of impinging and impacting materials will decrease from its magnitude prior to reaching the interface. Following interaction at the interface between the 2 materials, particle velocity will increase in the impinging material compared to its value prior to the interaction. Shock wave velocity will be higher in the target material than in the impinging higher-impedance material.

The converse is true, also, meaning that a shock wave traveling through a low-impedance material into a material having a higher impedance will increase in pressure at the interface from its value just before reaching the interface. Particle velocity in the lower-impedance impinging material will decrease after interaction with the impacted material.

Significantly, particle velocities as well as shock pressure at interfaces must be equal. Also important is the fact that particle velocities double at interfaces between gases and condensed phases. These two facts have substantial ramifications for mitigation of quasi-static blast loading by hot gas at high pressure and for minimizing damage in armor materials impacted by projectiles.

Projectile Impact

When a projectile impacts a target having higher impedance, the shock wave reflected from the projectile/target interface transmits to the free surfaces at the sides and rear. At these surfaces, the shock wave reflects again, traveling through the projectile as a rarefaction or relief wave having the pressure of the surrounding medium, or ambient pressure. Upon reaching the target/projectile interface, this rarefaction wave is transmitted into the target. The two materials then are induced to separate unless held together in tension by strong bonding.

When the opposite case obtains, namely when a projectile strikes a target of lower impedance, a more complex series of events develops. Multiple shock wave reflections occur at the projectile/target interface. If both target and projectile are relatively short or thin, numerous reflections will develop between the target/projectile interface and the free surfaces. Each positive-pressure shock wave will transmit into the target material, although each successive shock wave will be weaker than the preceding one. Rarefaction or relief waves develop each time a positive-pressure shock wave reaches a free surface.

Should a material or assembly disintegrate during its interaction with a blast, conditions in the immediate vicinity of the shattered medium would be constrained by the shock pressure at that moment. Many new free surfaces would be created, and pressures at the numerous new interfaces between gas and shattered material would be the same. If shock pressure within the material is strongly reduced prior to disintegration, then pressure within the shattered components and the surrounding gas will be correspondingly low. Shock wave and particle velocities would be substantially reduced as well. If the shattered material or assembly was serving to isolate the environments on either side, then the reduced pressure on the blast side would be felt on the opposite side.

Ranges of Shock and Projectile Impact Parameters

The range of important properties of hot blast product gases must be considered in designing protective means. This is because most vehicles and structures exposed to blasts may be faced with a range of charge weights, explosive materials, and degrees of confinement.

For large ground mine detonations beneath vehicles, such as a 10-kg TNT charge at a spacing of 30 cm from the vehicle underside, multiple reflections of shock waves between vehicle and ground will occur. Gas density may exceed 30 kg per cubic meter at temperatures exceeding 1,500 degrees Kelvin. Peak pressure may exceed 2,000 bar. Duration of the positive overpressure will certainly exceed 100 milliseconds if detonation occurs near the center of the vehicle underside. Roughly similar conditions will prevail near a large wall impacted by a blast wave generated by a 5,000 kg TNT detonation 5 meters away.

Duration of shock wave propagation within solid components of protective assemblies is much shorter with projectile impacts. Armor layers are typically in the range of 6 mm to 60 mm for vehicle undersides and for protection of sides and top against automatic rifles and machine guns. Similar armor is used for protection against fragments produced by exploding artillery shells. A projectile or shock wave moving at 1 km/s travels 10 mm in 10 microseconds.

Gun-launched projectiles typically travel between 0.5 and 1.5 km/s. Artillery shell fragments near the bursting projectile travel between 1.3 and 3 km/s. This overlaps the range for explosively-formed penetrators (1.5-3 km/s). Particle velocities produced by projectile impacts and with layers within armor assemblies subjected to shock loading from contiguous layers typically range from 0.5 to 1 km/s. Thus one can see that high pressure durations associated with exposure to shock waves and projectiles are on the order of 1/10th that of blast load durations imposed by hot blast gases.

Peak and average pressures created by projectile impacts are much higher than overpressures from hot gas products generated by detonations. Peak overpressure from large explosive charge detonations beneath vehicles will be less than 1 GPa (10,000 bar). Peak impact pressure from EFPs may reach 40 GPa and 30 GPa for high-velocity fragments and gun-launched projectiles.

In contrast to condensed phase detonations, deflagrations involving dusts and gases produce much lower overpressures and slow shock waves. Peak overpressures greater than 8 bar are difficult to produce even in laboratory conditions. Chemical process facility deflagrations rarely exceed 2 bar. Durations, however, are typically very long, and can exceed 500 milliseconds.

Aerogels for Mitigation of Blast Effects

An opportunity now exists to provide protection against a wide range of explosive threats through an invention utilizing aerogel materials. Aerogels are described in many publications, with U.S. Pat. No. 6,989,123 filed by Kang P. Lee et al being a particularly useful source.

Aerogels have set records for lowest density of any solid ever produced and the lowest acoustic speed (70 meters per second). They have also established the record for highest specific surface area (1,200 square meters per gram). Features common to most aerogels developed to date are quite desirable in blast protection roles.

Although commercially marketed aerogels have densities comparable to conventional rigid foams (specific gravities ranging from 0.1 to 0.3), structural differences are pronounced. The nanostructure of aerogels features characteristic dimensions of cells less than the mean free path of gas molecules. Inhibiting intermolecular collisions through aerogel's nanostructure would dramatically reduce heat transfer.

Acoustic wave propagation is similarly made difficult by aerogel nanostructure, so that even with comparable density, acoustic speed and thermal conduction of conventional rigid foams are much higher than in aerogels. In this regard, aerogels offer unique advantages over the recently-proposed use of hydrophobic zeolite materials saturated in water under pressure.

Surprisingly, aerogels typically feature significant mechanical strength and tolerance for elevated temperatures. These qualities, in combination with low acoustic velocity and low density, make aerogels quite suitable for mitigation of blasts.

Aerogel products are generally too fragile to be used alone, but innovative arrangements with other components can be used to meet desired levels of protection with weights and thicknesses considerably lower than protective assemblies made with the current art. Many materials would be suitable for use in blast protection assemblies in combination with aerogels. In particular, metal foams can be incorporated to advantage in these arrangements as can other components in synergistic combinations as described subsequently.

Referring to the formulae presented above, one can readily see that the remarkably low longitudinal acoustic velocity of aerogels would strongly decelerate transmitting shock waves. This is because particle velocity u, shock wave velocity U, bulk acoustic speed $C_0$, and actual (longitudinal) acoustic speed $C_L$ are of the same order of magnitude. The low density of aerogels would also greatly reduce transiting shock wave pressure due to the Bernoulli equation presented previously.

Since shock wave pressure and particle velocities must be equal at the interface between two materials in contact (such as between a projectile in contact with a target), aerogels potentially offer a means of strongly reducing shattering and plugging effects in target materials. The combination of reduced shock wave pressure and velocity would mitigate the environment around the blast or projectile impact on a target, even if the target is penetrated.

Blast protection possibilities with aerogels would apply to both normal and oblique blast wave impingement. The much-reduced reflected blast parameters would strongly attenuate Mach stem formation and propagation. Mach stem is the wave formed at low angles of blast wave impingement on surfaces by the combination of incident and reflected shock waves.

Aerogels thus theoretically offer advantages both for blast protection cladding of structures and for deflector assemblies. If designed and used properly, deflectors would theoretically benefit greatly from aerogel exteriors. This would occur due to the extra time before blast waves would transit the aerogel and reach the structure, thereby enabling more of the blast wave to be deflected away.

Aerogels and the Current Art for Blast Protection Armor

Using aerogels in the same manner that conventional cladding and deflector assemblies are presently used would undermine or negate their theoretical advantages. Most particularly, fragile aerogels would be exposed to a wide range of hazards. This approach would also fail to significantly reduce quasi-static pressure (QSP), since no heat transfer or significant aerodynamic drag losses would be produced.

Advantage of low reflected blast parameters would still obtain with aerogels used as cladding, but the very low shock wave and particle velocities would ensure superposition of incident and reflected shock waves when aerogel thickness exceeds 2 cm. This would result in increased impulse (momentum transfer) from the blast into the structure, even more than has been documented when aqueous and conventional solid foams have been similarly used.

Positive overpressure durations trapped in such layers would certainly persist for the durations typical of the intense blasts associated with ground mine detonations beneath vehicles and large charge detonations near sizable structures. Employment of thin aerogel layers would reduce duration of positive shock wave overpressures within the aerogel but would prevent the aerogel from substantially reducing blast pressure and velocity.

Expanded Metal Products for Blast Mitigation

Suppression of deflagrations has been demonstrated using cellular product forms that decelerate flame front velocity and extract heat from it. These products have appeared as reticulated foams and beads comprised of slit metal foil. Reticulated foams have been made from polymeric materials and by expanding slit aluminum foil into a flexible batt form. United States military specifications exist that cover both types of products. Both types are employed in many military aircraft to suppress catastrophic fuel tank explosions.

Examples of commercially-marketed, expanded slit-foil beads include products tradenamed Explosafe™ and Firexx™. The much higher heat transfer coefficient of aluminum foil in these products render them more capable of rapid heat extraction from hot deflagration gas than polymeric reticulated foam. Both forms of products decelerate flame fronts and shock waves.

Mixed success has been found with products of the above forms using the current art. In many cases, they have clearly been successful in preventing major fuel tank damage. This is particularly the case in electric spark-initiated deflagrations. Strong deflagrations generated by exploding incendiary projectiles, however, accelerate the reticulated materials and slit-foil beads. Inertial loads so generated in reticulated foams have been shown to be destructive to the walls of fuel tanks.

Firexx™ has demonstrated effectiveness in mitigating blasts from detonating solid explosives when a significant distance between the charge and metal bead layer exists. A noteworthy example is a US Government test in which an unreinforced concrete masonry wall was kept intact by a barrier of Firexx™ when exposed to a moderately intense blast (approximately 1 $m/kg^{1/3}$ scaled distance). Blast product gas was unquestionably hot in this event when it encountered the Firexx™ barrier. The combination of aerodynamic drag energy loss from the blast wave, attenuation of reflected shock parameters, and rapid cooling during the QSP phase proved adequate for protecting this relatively weak wall. These characteristics are significant to development of blast mitigation assemblies.

A drawback to use of such materials is the substantial thickness required for them to mitigate blast parameters. Unlike aqueous foams and other two-phase cellular media, beads comprised of slit metal foils are poor acoustic and shock wave attenuators. Blast barriers must be at least 15 centimeters to effectively protect against blast intensities around 1 $m/kg^{1/3}$, and thicker for scaled distances less than this. Containers and tanks must be mostly or completely filled in order to suppress blasts in fuel vapors. Many applications, such as containers and the underside of vehicles, do not have space to allow such thick protective barriers.

Metallic Foams

Metals can now be manufactured that have cellular or spongiform internal structures and solid surfaces. With the current art, the largest cells or void space is around the center, with decreasing porosity near the surfaces. Presently, metallic foam plates can be made having less than 50% of solid bulk density.

Aluminum has been the most popular metallic foam commercialized to date, but metal foams using other metals have been produced. Variable density and non-uniform cellular or spongiform internal structure offers possibilities of usefulness in disrupting gas flow at high velocity as it transmits into the interior of a metallic foam. In particular, the acoustic speed of solid aluminum is high, being more than 6,000 meters per second. Such a high acoustic speed would allow shock waves to propagate over a wide area along the surfaces of aluminum foam.

Increasing porosity and the spongiform internal structure would greatly reduce this acoustic speed in the middle of aluminum foam. Thus a shock wave generated either by projectile impact or intense blast wave impingement would distribute over a wide area transverse to the direction of shock wave propagation while propagation along the incident direction would be substantially reduced.

Frangible Materials

Frangible materials and components are those that shatter easily upon blast load incidence or impact. Very little energy is dissipated in this process but reflected shock wave intensity is greatly reduced compared with tough surfaces. Thin glass, for example, is frangible but thick glass plate is not.

Frangible surface components may serve to provide a washable surface or otherwise isolate the external environment from the opposite side. Within an assembly consisting of several layers, a frangible component may serve to confine or retain other components as well as to separate spaces.

Thin plastic sheets and rigid foam boards are frequently used as frangible components. This is because they have low mass and disintegrate quickly. However, they feature relatively low acoustic speeds and therefore cannot quickly redistribute shock waves transverse to the incident direction.

Blast wave parameters for the gas transmitting through the disintegrating component are at least as great as at the intact frangible surface. This facilitates intense, localized blast loading of the rear components and beyond.

Metals, with their inherently high acoustic speeds would thus be preferable as frangible elements. Their yield strength, mass, and ductility make them inappropriate, however, even when very thin. Because of their strength at low pressure, metals are typically used as rupture disks in safety equipment for the chemical process industry and as diaphragms in laboratory shock tubes.

Ceramic materials typically have acoustic speeds higher than metals, which is desirable. They also are generally amenable to shattering upon impact and blast pressure. However, their densities are typically very high and are generally more expensive than metals.

Metal foams would be preferable to solid metals because of their lower density. Stress and shock waves would travel quickly along the continuous surface layers while traveling much slower through the spongiform internal structure. Unless weakened in preferred patterns, however, metal foams would remain intact. Remaining intact would prevent the desired frangible behavior.

Frangibility can be introduced with all of these materials by bonding small pieces of each into sheets or other desired shapes. Ceramic pieces of tungsten carbide or alumina, for example, could be bonded by adhesives or resins and then formed as sheets. The same could be done with metal foam pieces, plastic and glass beads, and metals. This technique is within the current art.

Nozzles and Ducts

Energy losses are generated in gas flow in ducts, pipes, and nozzles at high mass flow rates. Friction along the walls increases as gas velocity increases. Unless properly designed, turbulence will also develop at high flow rates. For gas flow around the acoustic speed, complex, secondary shock phenomena will develop in ordinary ducts.

Maximum mass flow through a nozzle (a duct with a reduced area at one location) will occur at the acoustic speed of the gas medium. Ducts with constant cross sections cannot achieve as high a mass flow rate as can happen in proper nozzles with throats having the same cross section as the duct. Shock waves reflecting off the surfaces of imperfect nozzle walls and ordinary ducts generate complex, secondary shock phenomena. Turbulence ensues as a result, and mass flow rate is reduced from the theoretical maximum.

For intense blast loads near large surface areas, high mass flow rates of the impinging gas directed away from the surface are required in order to prevent unacceptable damage. This fact suggests that arrangements within assemblies intended to reduce blast loads on structures, container walls, and vehicles must perform as nozzles.

DISCLOSURE OF THE INVENTION

In view of the shortcomings of utilizing materials in existing assemblies to adequately mitigate blast effect, a need for an improved blast effect mitigating assembly has been found. The present invention accordingly offers a means for providing adequate mitigation of blast effects, particularly the attenuation of shock waves and substantial reduction of quasi-static pressure against an object caused by gas generated by an explosion. More specifically, the invention provides a means or assembly for substantial mitigation of effects caused by explosions whether proximate or remote, and whether confined or produced in unconfined environments. As discussed in greater detail elsewhere, an aspect of the present invention contemplates an assembly comprises a layer of an aerogel on the side that faces an anticipated explosion, a space suitable for a gas to occupy, a frangible element immediately behind the aerogel layer that separates the aerogel layer from the space, and a back surface that defines the space.

Objects and Advantages

Accordingly and in view of the above summary, the invention has a number of objects and advantages set forth as follows:

(a) to utilize the low acoustic speed and low density inherent to aerogel materials in substantially reducing blast wave pressure and velocity while simultaneously avoiding the enhancement of quasi-static pressure;

(b) to substantially mitigate all destructive mechanisms created by severe explosions without contributing additional means of causing damage or injury;

(c) to make a substantial advance to the art of blast protection of structures, vehicle, and containers with thinner, more compact products of much lower weight than achievable through current technologies;

(d) to rapidly distribute shock wave and blast wave loads transverse to the initial direction of these waves so as to reduce local stresses in the assembly, thereby reducing the ability of a blast to shatter or create plugs of dislocated material from components loaded by a severe blast;

(e) to utilize the high mass flow velocity of gas present in severe blast environments to divert substantial fractions of this gas around an object being protected with embodiments of this invention;

(f) to avoid the enhancement of blast wave momentum transmitted into objects requiring protection caused through employment of the current art of deflectors and armors;

(g) to substantially accelerate the rate of cooling hot gas present in severe blast environments, thereby reducing quasi-static pressure load imposed on objects to be protected against explosions;

(h) to utilize the internal structure of metal foams to simultaneously generate substantial aerodynamic drag energy subtractions from an impinging blast, to rapidly cool this hot gas, to create multitudinous rarefaction waves within an impinging blast and within penetrating projectiles, and to extend the duration of rarefaction waves in synergistic combination with the contiguous aerogel material;

(i) to enable embodiments to be readily fabricated as separate assemblies that can be affixed to a wide variety of existing structures or alternatively be integrated into the design and construction of new structures;

(j) to offer a light, compact means of achieving simultaneous protection against blasts and projectiles;

(l) to provide a single, practical assembly that performs adequately over a wide range of blast intensities and for protecting a wide variety of structures, vehicles, and containers that require protection against explosions;

(m) to provide compact assemblies for protecting against severe explosions that can be cleaned, decontaminated, and painted without degrading blast mitigation capabilities;

(n) to offer containment products that can substantially mitigate heat and pressure in gas released outside these containment products so that people near the explosion event will be protected from injury; and (o) to create synergisms between aerogels and metal foams not previously possible for providing mitigation of intense blast waves. It may be the case, however, that no one particular embodiment of the invention features all of the objects and advantages enumerated above.

The invention disclosed herein circumvents numerous shortcomings of all existing means of protecting structures, vehicles, and containers against explosions. In addition, the invention creates a wide range of opportunities for providing protection against severe blast threats through novel utilization of aerogel materials alone or in combination with a substantial range of materials.

These materials can be beneficially used in many different configurations to achieve desired protection against harmful effects created by explosions. Although the present invention emphasizes protection against blast pressure and impulse, one can readily see in the formulae presented above that it can help reduce the ability of projectiles and munition fragments to penetrate armor and structural walls.

Regarding projectiles, impact pressure is reduced by the strong reductions of $C_0$ and p of aerogel through the invention. Since P is same on both sides of impact interface, shock pressure can be dramatically reduced. In combination with layers of materials having high acoustic speeds to laterally distribute impact and shock loads, back layers can be protected against shattering and plugging induced by projectile impact. Further objects and advantages will become apparent upon consideration of the drawings and description of the embodiments of this invention.

BRIEF DESCRIPTION OF THE DRAWINGS

In the drawings, closely related figures have the same number but different alphabetic suffixes.

Figure 1:
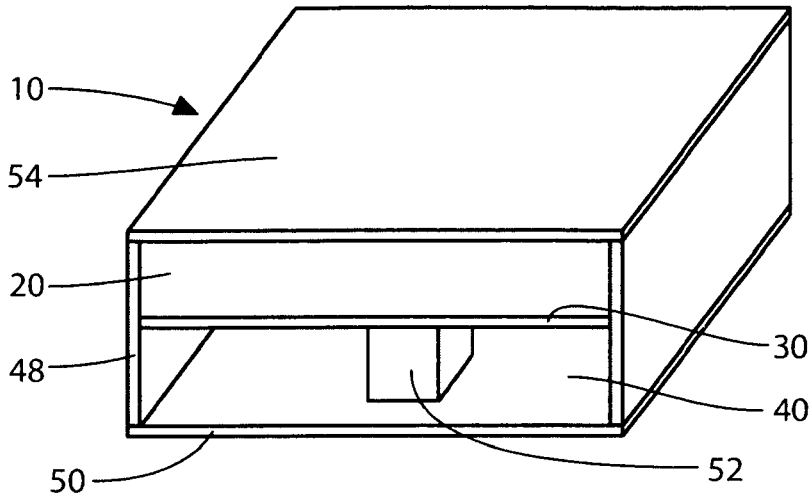
FIG. 1 illustrates a first embodiment of a basic blast effect mitigating assembly using aerogels.

REFERENCE NUMERALS IN DRAWINGS 10 assembly
20 aerogel layer
30 frangible backing component
40 space
48 side wall
50 rear surface
52 rigid foam block
54 frangible exterior component 56 channel
60 opening
64 frangible cover
68 flexible bag
70 grating
80 flowable medium
84 confining component
90 frame
100 vertex
104 backing component
108 frangible separator
110 inclined rear surface
112 bracing
120 underside of vehicle
130 container

MODES FOR CARRYING OUT THE INVENTION

The various drawing figures accordingly depict a number of embodiments according to the present invention. Those embodiments are summarized below followed by a more detailed description of the respective figures.

FIG. 1 shows a first embodiment of the blast mitigating assembly using aerogels. The assembly 10 has an aerogel layer 20 arranged to face the direction of an anticipated blast with a frangible backing component 30 for mechanical support. A space 40 is created and defined by said frangible backing component, sidewalls 48 and a rear surface 50. Rigid foam blocks 52 are shown that maintain dimensions and prevent collapse of the space.

Aerogels with tensile and compressive strengths substantially greater than those reaching the market in 2005 would be desirable so as to increase resistance to abrasion and light impacts typical of ordinary use and maintenance. Other embodiments would allow use of aerogels poured onto the frangible element where they cure in place, or alternatively may be flexible or rigid sheets already formed prior to incorporating in an assembly.

The frangible element separating the space from the aerogel layer could be made from aluminum foam. A foam with solid surfaces and spongiform internal structure could be sectioned to form two components, with each component having a spongiform surface and a solid surface on the reverse. Two frangible elements suitable for use in this assembly would thus be created from one block or plate of aluminum foam by this sectioning process. In any event, substantially solid or unperforated surface would face the space and the spongiform structure would face the aerogel.

The rear surface may be formed by the object to be protected against explosions, such as a wall of a building or the floor structure of a vehicle. Alternatively, the rear surface—whether inclined or parallel with respect to the aerogel layer and frangible element directly behind, may be part of an assembly that is affixed to the structure or vehicle to be protected.

The space may be prismatic or have some other symmetrical form. Alternatively it may be irregularly shaped, such as if defined by dividing walls or bulkheads as encountered in aircraft and vehicle compartments. The space may be completely sealed or have openings. Defining walls may be formed from several components or comprise a single component, such as a formed pan or dish. The aerogel may be supported and the space dimensions maintained by alternative means, such as rigid foam blocks 54, short lengths of rigid tube, structural shapes such as angles and channels, blocks made from honeycomb, viscoelastic solid materials, or other solid form.

A frangible exterior component 54 may be placed between the aerogel layer and the direction of an anticipated blast to be mitigated by the assembly. Use of a frangible exterior surface would provide protection of the aerogel against incidental abrasion and minor impacts inherent to outdoor exposure. This surface would also facilitate cleaning and removal of mud, grease, and other contaminants. A similar frangible component could be used internally as a separator between additional blast mitigating assemblies using aerogels should these be stacked or otherwise connected substantially in parallel.

Figure 2:
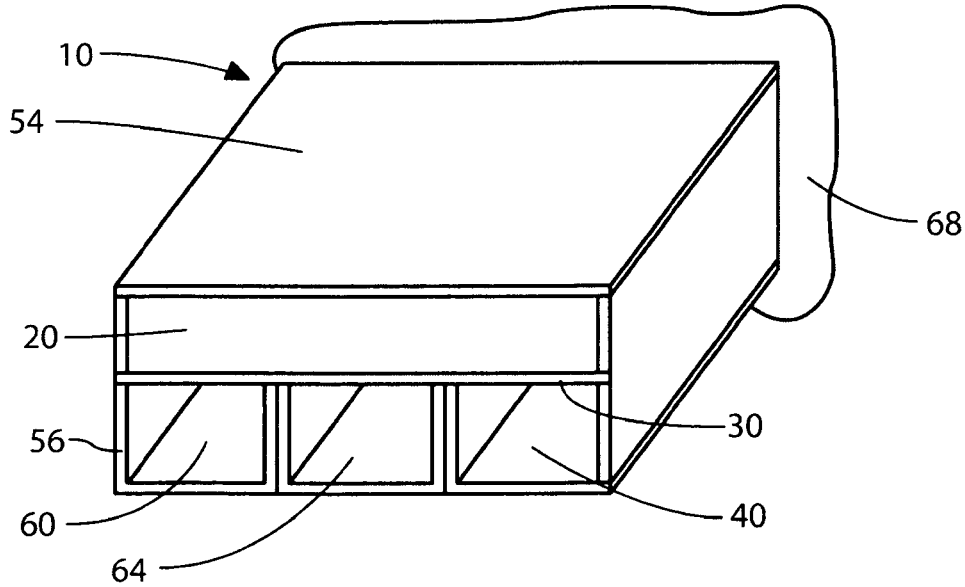
FIG. 2 shows a plurality of channel shapes used to support the aerogel layer and frangible element while simultaneously creating numerous spaces.

FIG. 2 shows a plurality of channels 56 used to provide mechanical support of the aerogel and frangible backing component. These channel shapes define and maintain the dimensions of the cross sections of each space prior to interaction with an explosion. A channel includes at least two sides and a base located between and connecting the sides. Either aluminum or composite fiber/polymeric resin matrix channels would serve in selected embodiments. If the sides of the channels are formed or machined at an inclined angle with respect to the base, then nozzles appropriate to gas flow at supersonic velocity would be created. A plurality of such channels in parallel arrangement would form an assembly with integral rear surfaces that deflect the maximum possible mass flow of blast gas transmitting through the aerogel into the spaces.

Such an assembly creates openings 60 to the exterior environment. Openings will allow pressurized gas and debris transmitting from below the assembly through the frangible element into the spaces to vent outside. An opening may be sealed by a frangible cover 64 or alternatively by a flexible bag 68 that substantially expands when filled by gas and debris produced by an explosion. Frangible covers may be placed between the space and flexible bag, or alternatively between the flexible bag and external environment. When maximum blast gas flow out exits from spaces is desired, honeycombs and other forms that serve to form multitudinous closed cells should be avoided.

Figure 3:
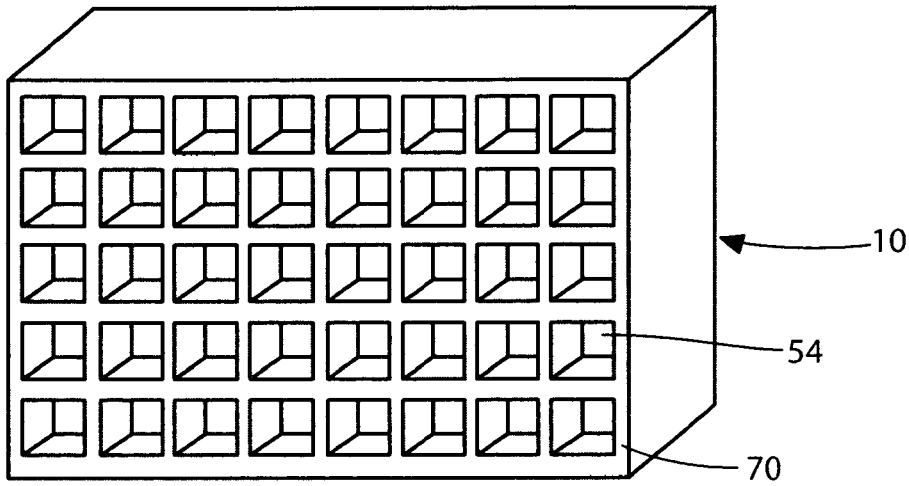
FIG. 3 illustrates the use of grating on the surface exposed to a blast.

FIG. 3 illustrates a grating 70 placed between the aerogel layer and anticipated source of an explosion. A grating or other grid-like component may be placed directly in contact with the aerogel layer or a frangible element if one is used to cover the aerogel. The grid-like component may be alternatively a lattice or eggcrate, grating with rectangular openings, or a honeycomb having cells at least one centimeter minimum opening dimension. In one embodiment, a grating would be used, with minimum dimension across any cell being at least two centimeters. The grating or grid-like component should be sufficiently robust for the conditions of service of the assembly. Openings of cells should be large enough to allow mass flow at the maximum allowable blast gas velocity. The axes of the cells may be arranged to be substantially normal to the surface of the aerogel layer, and the component including the plurality of cells is substantially open such that gas can flow freely from the side facing the anticipated explosion into the aerogel layer.

Figure 4:
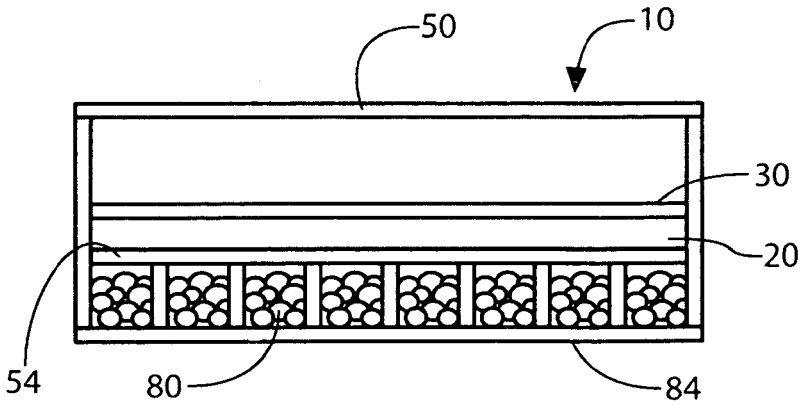
FIG. 4 depicts the use of flowable, blast-mitigating beads placed with the grating of FIG. 3 with suitable confinement by a frangible exterior component.

FIG. 4 illustrates a blast effect mitigating assembly using aerogels with cells of a lattice or grating substantially filled with a flowable medium 80. A flowable medium is one capable of being poured in the nature of liquids or granular solids. This flowable medium is intended to remove energy from impinging blast gas primarily through aerodynamic drag. However, such materials will increase turbulence in impinging blast gas. This, combined with shock wave/turbulence interactions, will dramatically increase heat transfer from hot gas to the flowable medium.

The flowable medium should be beads having diameters between 3 and 20 millimeters (mm) in diameter, and may be spheroidal, ellipsoidal, or prismatic. Suitable beads would be slit metal foil such as products currently sold under the tradename "Firexx™" and "Explosafe™", clusters made from bonding numerous hollow microspheres or granules of volcanic foam glasses such as pumice and perlite, and beads made from open-celled reticulated foam and aluminum foam. Firexx™ is a tradename of Firexx Corporation of Riyadh, Saudi Arabia and refers to products substantially comprising multiple sheets of expanded metal net separated by a porous material as described in U.S. Pat. No. 5,563,364. Explosafe™ is the tradename of Inertis Holding AG of Zug, Switzerland that applies to products made into a range of shapes from layers of slit metal foil expanded to form multitudinous hexagonal openings. A plurality of such beads should be placed in the cells, so bead diameters must be sufficiently small to allow this.

Beads made from slit aluminum or aluminum alloy foil such as Firexx™ would be satisfactory for most applications. This selection is particularly applicable to very intense blast environments. Blast intensity so contemplated would be created by solid explosive charges exceeding the equivalent of 10 kilograms of TNT detonating at a distance no greater than 0.3 meters from the surface of the blast effect mitigating assembly.

Alternatively, multitudinous beads or short cylinders of tungsten carbide or other dense material may be used for the purpose of preventing penetration by projectiles. Such dense materials will blunt and deflect even dense projectiles. Relative displacement of very dense flowable media allow rapid momentum transfer from transiting projectiles, thereby distributing loads over a wider area and thus reducing impact stress in the rear surface. Mixtures of beads of substantially different densities in the same cells of gratings would preferably not be used so that settling and damage to the lighter beads could be minimized.

When a flowable medium is used, it should be confined by a component 84 that will allow blast gas to flow through and into the aerogel layer. This can be accomplished by a frangible layer or otherwise by perforated metal sheet. Dimensions of perforations must be smaller than the diameter of the flowable bead medium to be confined.

The frangible layer may be comprised substantially of tungsten carbide or similarly dense material pieces bonded by a resin or adhesive material. This embodiment would be used in assemblies that must prevent penetration by shaped charge jets and explosively formed projectiles.

Figure 5:
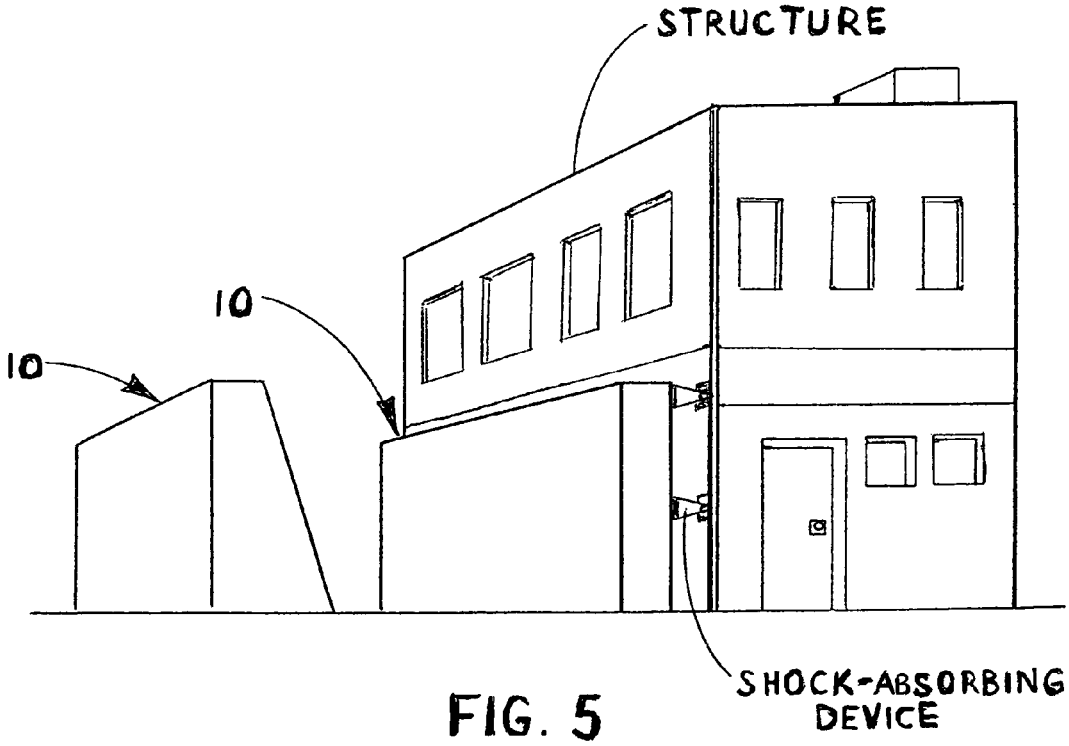
FIG. 5 shows alternative methods of employing the blast effect mitigating assembly using aerogels to protect a structure. One assembly is used as a barrier that is maintained erect and in place without connection to the object being protected from an explosion on the opposite side of the barrier. A similar assembly is connected to the structure using shock-absorbing devices.

The blast effect mitigating assembly using aerogels may be used as a barrier supported in place without any attachment to a structure or other object to be protected from blast, as is illustrated in FIG. 5. Alternatively, the assembly may be attached in some way to a structure or other object as is also depicted in FIG. 5. Attachments to structures or vehicles being protected against blasts can be designed or selected to yield at loads below the load that would inflict unacceptable damage to the structure or vehicle. Shock absorbers could be used in attachments in many applications.

When used as a barrier without support by a structure, heavy frame and rear surface components should not be used. This will prevent the assembly from becoming a projectile under blast exposure capable of penetrating structures or seriously injuring people. Other components of the blast effect mitigating assembly using aerogels are inherently light so they would avoid forming a secondary projectile hazard.

Figure 6:
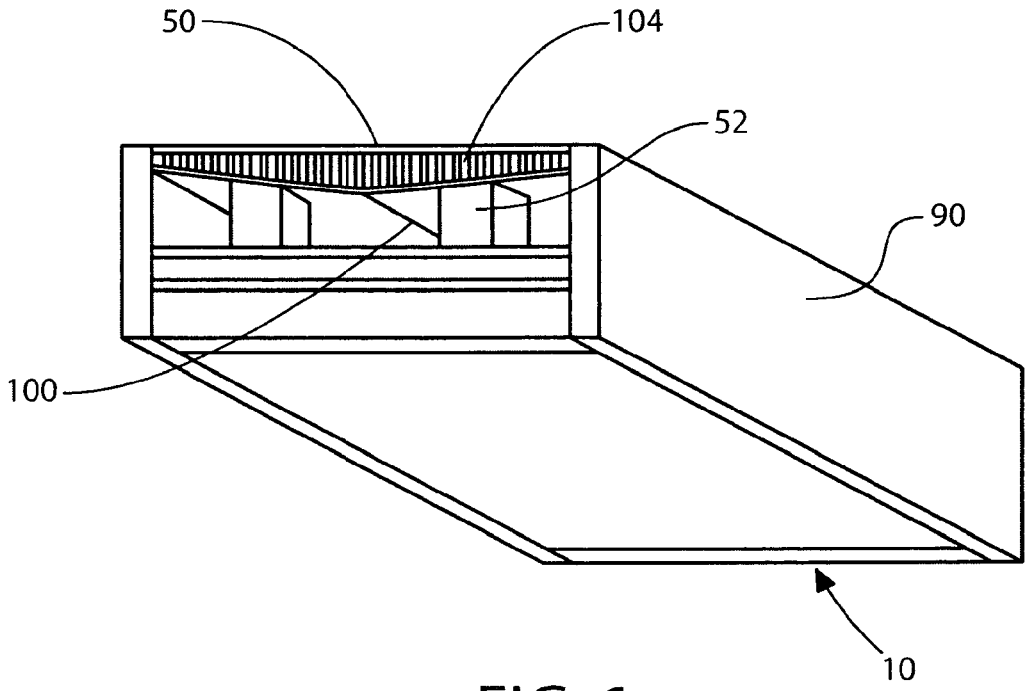
FIG. 6 shows the blast effect mitigating assembly with a frame that joins all of the components, including the rear surface, into a unitary structure.

FIG. 6 shows a structure incorporating a blast effect mitigating assembly using aerogels with a frame 90 that holds all components together, including the front and rear surfaces, the aerogel layer, frangible layer, and all other optional components. The terms "front" and "rear" are defined in relation to the anticipated direction of the explosion. The rear surface in FIG. 6 is made to form two angles with respect to the rear of the frangible component separating the aerogel from the space. Vertex of the angle 100 is shown equidistant between the openings on opposite sides of the structure.

The rear surface may be placed in contact with a backing component 104 that limits blast load transmitted into objects connected to the assembly to the load that causes yielding in the backing component, which in this figure is a metal honeycomb machined to form the desired angles. Alternatively, the rear surface may be formed from machined polymeric foam, wood, or metal foam. A frangible sheet component may be optionally used to form the rear surface and supported either by machined foam blocks, wood, or honeycomb.

Figure 7:
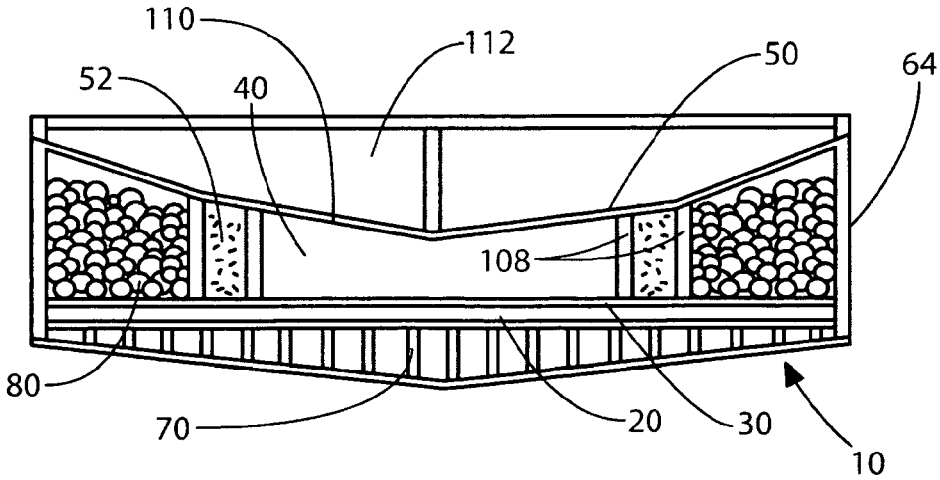
FIG. 7 shows flowable media placed in the space near openings.

FIG. 7 depicts a blast effect mitigating assembly using aerogels similar to that shown in FIG. 6 with part of the space filled with a flowable medium. A frangible separator 108 keeps the flowable medium in the desired location. The flowable media in this space would be Firexx™, Explosafe™, or similar slit metal foil beads. Such an embodiment would be particularly desirable where gas produced by an explosion would be vented in confined areas, such as from vehicles traveling in narrow streets or tunnels. This is because such flowable media will strongly decelerate vented gas as it is ejected along with the gas, and yet avoid becoming lethal projectiles because they are so light. Dense flowable media such as tungsten carbide or solid ceramic spheres or cylinders should not be used anywhere in the space between the rear surface and the aerogel layer facing a blast. This figure also features bracing 112 and an inclined rear surface 110.

Figure 8:
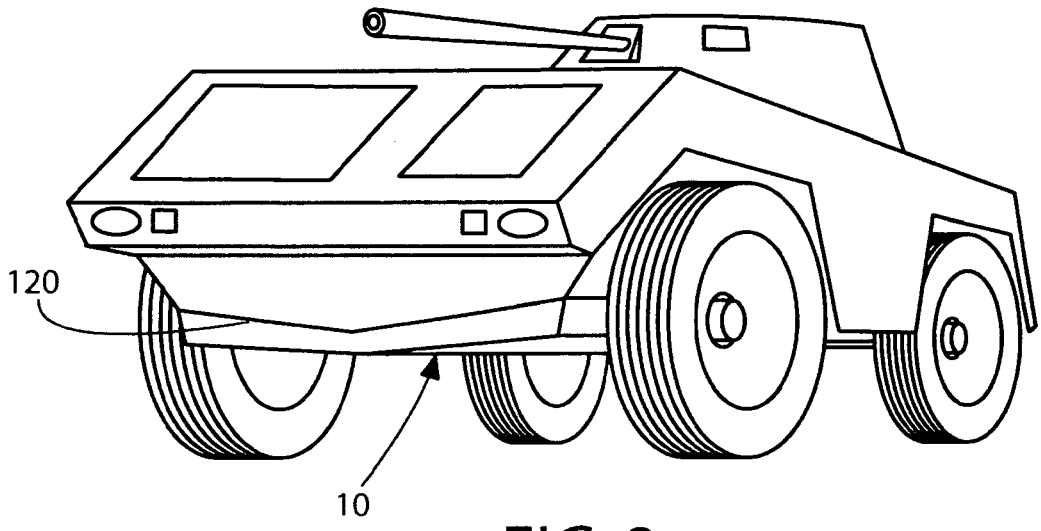
FIG. 8 depicts a blast effect mitigating assembly using aerogels mounted to the underside of a vehicle such that the vehicle floor serves as the rear surface, and with the vehicle underside surfaces sloped with respect to the front surface of the blast effect mitigating assembly using aerogels.

FIG. 8 illustrates a blast effect mitigating assembly using aerogels mounted on the underside of a vehicle 120 and in which the vehicle underside serves as the rear surface. The underside may be that of any vehicle with ground clearance exceeding 0.3 meters, including an armored vehicle with a floor capable of stopping fragments from an artillery shell detonating in close proximity.

Figure 9:
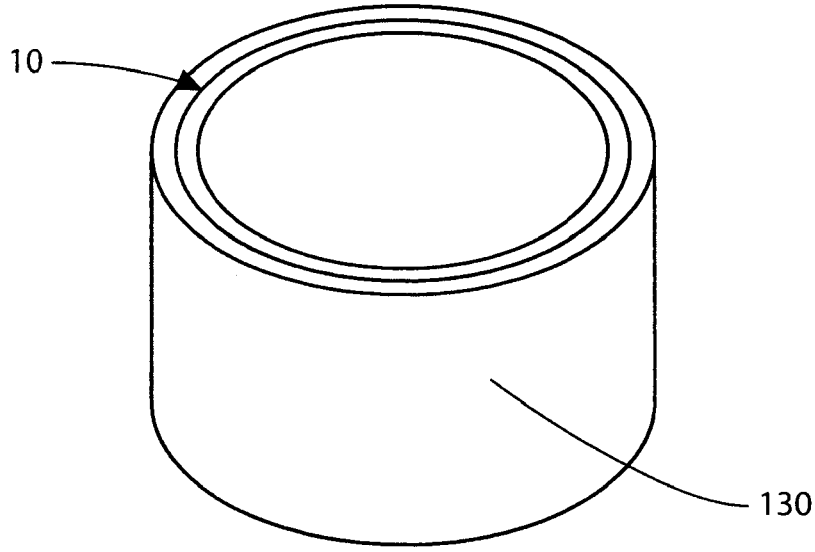
FIG. 9 illustrates a round container with the blast effect mitigating assembly using aerogels as a lining.

FIG. 9 illustrates a blast effect mitigating assembly using aerogels that lines a round container 130. Aerogel products currently are available in flexible batts or sheets that are readily formed into curvilinear shapes. Containers substantially or completely lined with the blast mitigating assembly may be any shape that serves the function of containing specified materials, such as prismatic forms.

Advantages

The invention offers numerous alternatives for a person skilled in the art to design and make blast mitigation products. Effective assemblies can be made from materials and using fabrication processes already in the current art. New materials and fabrication processes may be developed in the future that could further enhance capabilities within embodiments discussed elsewhere.

All embodiments would increase the extent of blast mitigation possible over any means available in the present art for a specified weight and a specified thickness of protective material. This advance in capability would make blast protection possible in many more applications where weight and space constraints prevent employment of effective assemblies using the present art.

Placement of variations of this assembly on the inside of containers would greatly increase the size of explosive charge that could detonate inside without causing failure of the confining walls. Containment devices that would benefit from various embodiments of this assembly range from trash receptacles to magazines for storage of explosive devices.

The alternative embodiments allowing for curved cross sections would enable a wide range of container shapes to be protected, such as cylindrical vessels and munition canisters.

Means of confining blast debris and gas inside a flexible bag placed at the exit of spaces in the assembly would allow trash receptacles aboard vehicles and mass transit railcars to be placed safely therein, because blast overpressure and shock waves would not be allowed to travel between tunnel walls and vehicle sides (or nearby tall structures) and cause window shattering or injury to people near open windows. Similarly, a vehicle driving over a detonating explosive utilizing this assembly would trap much of the gas and debris generated by the blast from injuring nearby soldiers or noncombatants. Yet another advantage made possible by an embodiment of this assembly would be a container for receiving mail and packages within a room that would confine blast gas and debris, thereby protecting occupants within the room from excessive overpressure, fragments, and heat stemming from an explosion within the container. Still a further advantage would be afforded by a magazine handling explosive materials in a laboratory or explosive device manufacturing plant, where blast products would be confined within the expanding flexible bag. Blast pressure and impulse released outside would be strongly reduced and shock waves formed by the blast would be strongly attenuated in the surroundings.

Operation

The different embodiments of the blast effect mitigating assembly using aerogels described herein emphasize protection against relatively severe blast environments. Severe blast conditions in the scaled distance range of 0.15 to 1.5 m/kg$^{1/3}$ are of particular relevance.

All embodiments of the blast effect mitigating assembly are expected to be heavily damaged or destroyed in an interaction with a strong blast wave. In all applications and regardless of damage inflicted upon the assembly, it will almost instantaneously remove a substantial fraction of transmitting blast wave energy through several dissipative processes. The residual energy of the blast wave after this interaction is intended to be insufficient for inflicting damage or injury deemed unacceptable by the user of the embodiments of this device.

The basic form of the invention becomes operable when blast waves of sufficient intensity impinge upon the outer surface of this assembly. Strong blast waves will penetrate and likely tear apart the aerogel layer and shatter the frangible element directly behind the aerogel. A shock wave will precede entrance of debris from the aerogel layer and frangible element, along with accelerated gas, into the space defined previously by the frangible element and the surface furthest from the incident blast wave.

The blast wave reaching the space behind the aerogel will be substantially decelerated and weakened. At substantially normal incidence to the assembly, the pressurized gas will move around and away from the object being protected by the shattered assembly in less than one second. This process will be faster for a blast wave impinging at an oblique angle. Regardless of the angle of blast wave approach, the assembly will generate reflected shock parameters no greater than incident parameters.

In the basic embodiment, velocity of blast gas may reach as high as 4 kilometers per second (km/s), or 4 millimeters per microsecond (mm/μsec). Here, the aerogel layer would be around 20 mm thick. Thus the blast wave would take from 5 to 10 μsec to transmit through an aerogel of this thickness—and longer for a weaker blast.

Because of the remarkably low acoustic speed of aerogel, the transmitting shock front would only travel 1 to 5 mm ahead of the accelerated gas in this short distance. Nonetheless, air on the side of the aerogel opposite the blast-loaded side would be at ambient pressure and density. Impedance Z (which is defined as the mathematical product of density p and the shock wave velocity U) of the confined air would be lower than in the hot blast gas. A rarefaction, or relief wave, would thus be reflected from the aerogel surface in contact with the ambient air back into the aerogel.

This rarefaction wave would be at ambient pressure. It would travel back through the disintegrating aerogel at a particle velocity u of twice the velocity at the air/aerogel interface before the blast wave arrives. Because shock wave and particle velocity are restricted to the acoustic speed in aerogel (or the mixture of blast gas and disintegrating aerogel) by the relationship $U=C_o+su$, (and $C_o$ is close the actual acoustic speed), duration of the rarefaction would still be long with respect to duration of blast loading. Maximum particle velocity would be in the range of 0.2 to 0.5 km/s, or 0.2 to 0.5 mm/μec—or possibly up to 1 mm/μsec if disintegration is increased by numerous fragment impacts.

Therefore duration of the rarefaction in a 20 mm aerogel layer would be at least 20 μsec, and more likely between 50 and 100 μsec. This simple assembly would therefore produce a rarefaction wave that would last for most if not all of a blast event, including quasi-static loading phase caused by trapped, high-pressure gas. It would also assure that reflected pressure and impulse would actually be lower than incident. The net result would be a substantially reduction in blast loading of an object behind the assembly.

Embodiments incorporating aluminum foam and aluminum beads open to gas flow internally would be especially useful in rapidly cooling hot gas. Rapid heat transfer would happen during both the high velocity blast impingement phase and during the subsequent quasi-static pressure phase. The linear relationship between pressure and temperature from the ideal gas relationship $P/p=RT$ applies, where P is pressure, p is gas density, R is the gas constant applicable for the blast gas, and T is gas temperature.

As an example, heat transfer rate to drop blast gas temperature from 2,000 to 1,800° K would be 200 degrees per 20 milliseconds, or 10 degrees per millisecond. Even higher cooling rates than 10 degrees per millisecond would be readily achieved through embodiments of this assembly, particularly when metal foam components with the spongiform structure is exposed to impinging hot gas.

This is because metal filaments of the spongiform structure within a metal foam are typically 1 mm or less in thickness. Such fine filaments would not create thick boundary layers. Heat from the impinging blast gas would only need to travel between 1 and 10 mm through the boundary layer to reach metal foam filaments. Velocity of impinging gas from a severe blast would be between 0.5 and 4 meters per millisecond, and this gas would be in contact with the spongiform structure at least 5 to 20 milliseconds.

A satisfactory metal foam for rapid heat transfer from the hot gas would be aluminum because of its high thermal conductivity. Heat energy transferred from the gas, or enthalpy change at the exit from this component $h_e$ (kilojoules per kilogram, of kJ/kg) to the filaments of the metal foam $h_i$ is approximately the product of heat capacity at constant pressure $C_p$ (kJ/kg—degrees Kelvin, or ° K) and difference in temperature between gas and filaments ($T_e-T_i$). Thus temperature change $T_e-T_i$ would approximately be $(h_e-h_i)/C_p$. $C_p$ is low for aluminum, so temperature drop will be substantial.

In embodiments where a layer of metallic beads is placed between the aerogel layer and explosion, substantial aerodynamic drag energy loss will be generated. Drag energy loss increases as the square of velocity. This energy is instantaneously subtracted from the impinging blast wave. The large specific surface area presented by multitudinous porous metallic beads will also ensure rapid heat transfer from hot transmitting gas. This will occur in beads either with spongiform internal structure or those fabricated from slit metal foil. The energy subtraction from impinging blast wave is similarly instantaneous and irreversible.

Similar benefits would accrue from having a thin metal foam serve as a frangible layer on the surface of the assembly closest to a blast. Full advantage of this arrangement would be achieved if this frangible layer comprised metal foam with the open-cell spongiform structure arranged to face the impinging blast. For metal foams made with solid surfaces, the spongiform internal structure could be exposed by cutting the foam roughly parallel with the surfaces. This operation would produce 2 blocks suitable for use as the frangible layer.

The embodiments of this blast mitigating assembly having rear surfaces inclined with respect to the frangible element take advantage of the reduced velocity of the dense gas in the space between the aerogel layer and surface furthest from the blast. The transmitting gas from strong blasts will be accelerated to velocities above the speed of sound in ambient air, thus supersonic flow conditions will obtain in these spaces. The cross sectional area of this space increases toward the exit of the space in accordance with requirements of supersonic nozzle's. Such a configuration allows the maximum possible mass flow of gas, along with any entrained debris.

A change in angle between rear surfaces and the frangible element will generate additional shock waves during supersonic flow. This will increase turbulent mixing of entrained debris and any bead material placed within the space prior to an explosion. This, in turn, will increase irreversible energy dissipation and reduce pressure of gas vented beyond the space.

Gas density in severe blasts from proximate detonations may theoretically reach as much as 40 kilograms per cubic meter at temperatures approaching 2,000 degrees Kelvin. At such pressure and approaching hypersonic flow conditions (roughly 10 times the acoustic speed of ambient air, or Mach 10), the cross sectional area of the duct or nozzle would need to be roughly 500 times the narrowest area in order to allow complete mass flow (that is, to avoid choked flow conditions). Reducing gas velocity to the range from Mach 2 to Mach 3, area required to transmit most or all of the gas is only 1.7 to 4.3 times the minimum cross sectional area. Use of slit foil or spongiform beads will accomplish the desired deceleration of the gas produced by the explosion. Required cross sectional area of the space created in variants of this assembly is practical for most applications contemplated as requiring blast protection, particularly the underside of vehicles and structures exposed to detonations of large explosive charges placed nearby.

These embodiments similarly take advantage of intense shock wave parameters. Most important among the latter are shock wave velocity and associated particle velocity (the speed at which particles accelerated by the transmitting shock wave move).

Most of the accelerated gas flow will occur around the multitudinous beads present in embodiments where such beads are used. Because of the small open area present in each bead, choked flow conditions will rapidly develop. A boundary layer around each bead will further make gas penetration into each bead difficult.

Heat transfer is normally quite low across shock wave boundary layers—on the order of 1/1000 of the heat enthalpy in the surrounding blast wave medium in laminar gas flow. However, severe turbulence will develop quickly because of the irregular and rapidly-changing profile of the air space behind the aerogel layer, along with the presence of multitudinous of the multitudinous beads vibrating and colliding with others. Shock wave/turbulence interactions increases heat transfer across the boundary layers by an order of 10.

Because the relative velocity of the accelerated beads will be lower in the space behind the aerogel layer, a greater fraction of gas flow will penetrate into the beads as they are blown into the space by the blast. Additionally, reduced velocity will provide more time for heat to transfer from the hot gas into the metallic beads and metal foam components when these are present.

Use of this combination of aerodynamic and heat transfer phenomena will substantially increase heat energy extraction from the transmitting blast wave beyond any degree previously achieved through other approaches. Thus temperature of the accelerated gas, if significantly above 300 degrees Celsius, will be substantially reduced.

Regarding projectiles and fragments, deeper penetration is more likely if stresses in the target material area are localized. Conversely, rapid propagation of shock waves transverse to projectile travel will reduce local stresses. The present invention makes this possible through the various embodiments that use aluminum foam frangible components and aluminum rear surfaces.

Additionally, shock wave reflections within metal foams, at aerogel/metal foam interfaces, and with multitudinous beads when used will cause expansion of both projectile and target material. This is due to the particle velocity doubling upon each incidence at high-to-lower impedance interfaces. There are innumerable such interfaces created with this invention, including projectile-air, bead-blast gas, aerogel filament-air and aerogel-metal foam interfaces. Expansion will increase friction during penetration.

Use of tungsten carbide beads in front of the aerogel layer will dramatically increase blunting of and momentum transfer from projectiles, thus reducing penetration ability. All embodiments will encourage deflection and eventual tumbling of a projectile, which further degrades penetrating ability. Use of frangible layers substantially comprising tungsten carbide or similarly dense components will further contribute to deforming projectiles, particularly shaped charge jets. Embodiments using grid-like components on the blast side and sloped armor layers for rear surfaces will be particularly effective in reducing blast impulse transmitting into structures and other objects requiring protection.

Ramifications and Scope

Accordingly, the reader will observe that assemblies made through this invention would offer substantial protection from explosions to buildings, vehicles, and other objects. Embodiments of this invention make protection possible against a wide range of explosive materials and devices, including those that generate projectiles and fragments.

Many other possibilities for mitigating blast effect using aerogels through the present invention than those described and illustrated above can be made by a person skilled in the art. The above embodiments are not intended to limit the application of concepts described above. Accordingly, the scope of the invention is defined only by the following appended claims which are further exemplary of the invention.

What is claimed is:

1. An assembly for protecting an object from an explosion, comprising:

(a) at least one aerogel layer arranged to substantially intercept shock waves and gas at pressure exceeding ambient before impinging upon the object, (b) at least one space between said aerogel layer and the object to be protected from the explosion, said at least one space being at least 1 centimeter in thickness;

(c) at least one component that defines said space and substantially resists deformation of the space prior to impingement from the explosion, (d) at least one frangible element separating said aerogel layer from the space; and (e) said at least one space is substantially created by at least one channel affixed to the frangible element and arranged such that the gas from the explosion transmitting through the aerogel layer and fragments from the frangible element can enter said space created by said channel, said channel comprising sides and a base connecting said, sides, the base of the channel being arranged furthest from a direction of an anticipated approach of the gaseous products generated by the explosion and toward the object being protected from the explosion.

2. The assembly of claim 1, in which the frangible element substantially comprises a metallic foam.

3. The assembly of claim 1, in which the frangible element substantially comprises a plurality of pieces, with each of said pieces having a specific gravity of at least 8.

4. The assembly of claim 1, in. which at least one component used to define the space behind the frangible element separating the aerogel layer from the space substantially comprises a frangible material.

5. The assembly of claim 1, in which a rear surface component for an integral part.

6. The assembly of claim 1, in which a component comprising a plurality of cells is placed between an anticipated direction of the explosion and the aerogel layer, the axes of said cells arranged to be substantially normal to the surface of the aerogel layer, and said component comprising the plurality of cells being substantially open such that gas can flow freely from the side facing the anticipated explosion into the aerogel layer.

7. The assembly of claim 5, in which the rear surface component is capable of resisting penetration by an object having a mass greater than 1 gram traveling at a velocity greater than 400 meters per second.

8. The assembly of claim 6, in which the cells are substantially filled with a flowable granular medium in which the granules comprise multitudinous bubbles filled with gas, said assembly further comprising a frangible component for confining said flowable granular medium between the aerogel layer and the anticipated explosion.

9. The assembly of claim 6, in which the cells are substantially filled with multitudinous beads having a spongiform structure, said spongiform structure allowing the transmission of gases from art explosion through said multitudinous beads into the aerogel layer, said assembly further comprising an element for confining said multitudinous beads between the aerogel layer and the anticipated explosion, said element substantially allowing passage of gas therethrough.

10. The assembly of claim 6, in which the cells are substantially filled with beads having a characteristic dimension of at least 3 millimeters and a specific gravity of at least 10 , said assembly further comprising an element for confining the multitudinous beads between the aerogel layer and the anticipated explosion, said element being substantially porous with respect to gas and impinging shock waves.

11. The assembly of claim 6, in which the cells are substantially filled with multitudinous beads having a characteristic dimension of at least 3 millimeters, said beads being made from metallic foil having multitudinous openings that allow transmission of gas therethrough, said assembly further comprising a frangible component arranged to confine the multitudinous beads between the aerogel layer and the anticipated explosion.

12. The assembly of claim 7, in which said rear surface is inclined at least 10 degrees from parallel with respect to the frangible element separating said space and the aerogel layer, said rear surface, frangible element separating the space from the aerogel layer, and other components that further define the space combining to form a diverging nozzle for gas transmitting through the frangible element into the space, an exit of said nozzle arranged so that supersonic gas flow is directed toward an environment outside of the object to be protected from the explosion.

13. The assembly of claim 11, in which the object to be protected comprises a container.

14. The assembly of claim 13, in which said aerogel layer, frangible element, and layer filled with beads are curvilinear in cross section, with each of said layers being substantially parallel to the other layers.

15. The assembly of claim 12, further comprising a flexible bag capable of expanding within a volume defined by said flexible bag, said expanding occurring under conditions of pressure exceeding external ambient pressure, wherein an opening to the environment external to said assembly is covered by said flexible bag such that gas and debris venting from said opening are substantially confined within. said flexible bag.

16. The assembly of claim 7, in which two surfaces of the space furthest from the explosion are inclined at least 10 degrees from parallel with respect to the frangible element separating said space and the aerogel layer, said two surfaces joining at the vertex of an angle so as to form two diverging nozzles for gas transmitting through the frangible element into the space, said nozzles comprising exits arranged so that supersonic gas flow is directed substantially opposite in direction from one another and toward an environment on opposite sides and outside of the object to be protected from an explosion.

17. The assembly of claim 16, in which at least one component is placed between the object to be protected from the explosion and the two rear surfaces inclined at least 10 degrees with respect to the frangible element of said assembly, said component crushing at a substantially constant load, the substantially constant load being lower than the load hitherto determined likely to inflict unacceptable damage to said object to be protected.

18. The assembly of claim 16, further comprising dividing elements that create a plurality of openings to an exterior environment of opposing sides of the object being protected against explosions by said assembly.

19. The assembly of claim 17, affixed to the underside of a vehicle capable of traveling on roads.

20. The assembly of claim 18, in which at least one of the openings to the environment external to said assembly is covered by a bag that confines gas and debris venting from said opening.

21. The assembly of claim 18, in which at least two of the spaces between the frangible element behind the aerogel layer and the rear surface are substantially filled with beads having a characteristic dimension of at least 3 millimeters, said beads having a spongiform structure that permits the flow of gases therethrough.

22. The assembly of claim 18, in which at least two of the spaces between the frangible element behind the aerogel layer and the rear surface are substantially filled with beads baying a characteristic dimension of at least 3 millimeters, said beads made from metallic foil having multitudinous openings that allow transmission of gas therethrough.

23. The assembly of claim 18, in which at least two of the openings of the spaces forming the exits to the external environment are sealed by frangible covers.

24. The assembly of claim 21, in which at least two of the openings of the spaces forming the exits to the external environment are sealed by frangible covers.

25. The assembly of claim 22, in which at least two of the openings are sealed by frangible covers.

26. The assembly of claim 6, in which said cells comprise at least one of lattices and gratings.

27. The assembly of claim 8, in which the multitudinous bubbles comprise at least one volcanic foam glass.

28. The assembly of claim 8, in which the multitudinous bubbles comprise pumice.

29. The assembly of claim 17, in which said component crushing at substantially constant load comprises aluminum honeycomb.

30. The assembly of claim 8, in which said cells comprise at least one of lattices and gratings.

31. The assembly of claim 9, in which said cells comprise at least one of lattices and gratings.

32. The assembly of claim 10, in which said cells comprise at least one of lattices and gratings.

33. The assembly of claim 11, in which said cells comprise at least one of lattices and gratings.

34. The assembly of claim 1, further comprising a frangible exterior surface.

35. An assembly for protecting an object from an anticipated explosion, comprising:

(a) an aerogel layer arranged to substantially intercept shock waves and gas at pressure exceeding ambient before impinging upon said object, (b) a space at least 1 centimeter in thickness, said space being located between the aerogel layer and the object, (c) at least one component that defines said space and substantially resists deformation of the space prior to impingement from the explosion, and (d) a frangible element separating the aerogel layer from the space, and further in which two surfaces of the space furthest from the anticipated explosion are inclined at least 10 degrees from parallel with respect to the frangible element separating said space and the aerogel layer, said two surfaces joining at the vertex of an angle so as to form two diverging nozzles for gas transmitting through the frangible element into the space, the two surfaces having a change of angle between the vertex and the exits of said diverging nozzles, and arranged so that supersonic gas flow is directed substantially opposite in direction from one another and toward an environment on opposite sides and outside of the object to be protected from an explosion.

36. The assembly of claim 35, affixed to the underside of a vehicle capable of traveling on roads.

37. An assembly for protecting an object from an explosion, comprising:

(a) at least one space defined by at least a front surface and a rear surface, the terms "front" and "rear" being defined in relation to the anticipated direction of the explosion;

(b) at least one aerogel layer; and (c) at least one frangible element so located as to separate said at least one aerogel layer from said at least one space, wherein said frangible element substantially comprises a plurality of pieces, with each of said pieces having a specific gravity of at least 8.

38. The assembly of claim 37, further comprising a frangible exterior component placed between said aerogel layer and a direction of the explosion.

* * * * *